United States Patent [19]

Scott

[11] 4,134,439

[45] Jan. 16, 1979

[54] PORTABLE INDUSTRIAL SCREEN

[75] Inventor: Richard D. Scott, Chicago, Ill.

[73] Assignee: Commercial Vehicle Parts, Inc., Elk Grove Village, Ill.

[21] Appl. No.: 809,074

[22] Filed: Jun. 22, 1977

[51] Int. Cl.[2] ..... A47G 5/00

[52] U.S. Cl. ..... 160/135; 160/351; 160/377

[58] Field of Search ..... 160/135, 351, 352, 377; 211/198, 199; 206/321, 602, 820; 220/23.2, 23.4

[56] References Cited

U.S. PATENT DOCUMENTS

| | | | |
|---|---|---|---|
| 190,171 | 5/1877 | Walker | 211/199 |
| 2,532,837 | 12/1950 | De Puy | 160/377 |
| 2,587,698 | 3/1952 | Corn, Jr. et al. | 160/135 |
| 3,125,155 | 3/1964 | Frommelt et al. | 160/377 |
| 4,063,585 | 12/1977 | Stanley | 160/135 |

*Primary Examiner*—Peter M. Caun

*Attorney, Agent, or Firm*—Darbo & Vandenburgh

[57] ABSTRACT

The adjacent sides of adjacent screen frames have juxtaposed grooves therein. A rubber band seated in the adjacent grooves and encircling the adjacent sides serves as a hinge connecting the frames. The frames have inverted tee-shaped feet which are frictionally engaged in tapered sockets at the bottom of the frames, yet may be withdrawn and rotated ninety degrees.

3 Claims, 9 Drawing Figures

Fig. 1
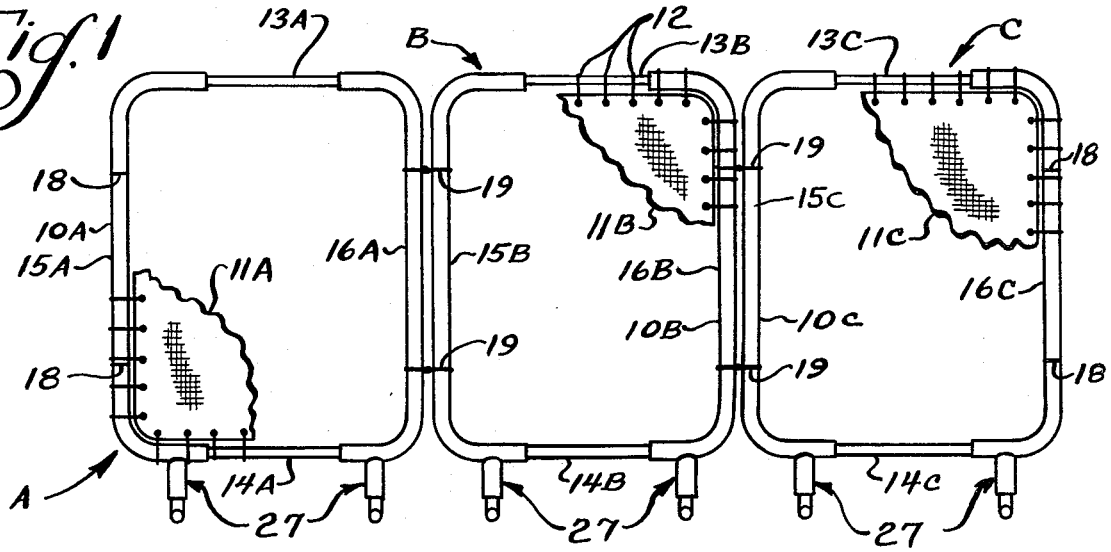
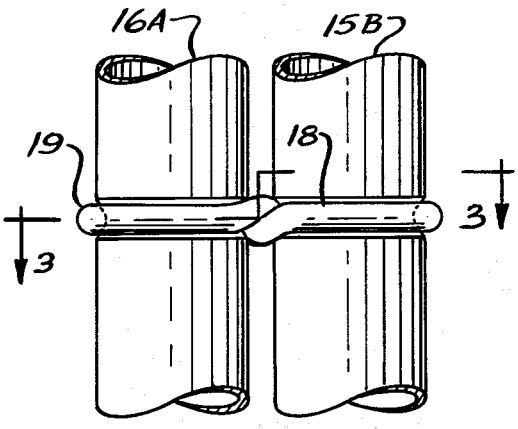
Fig. 2
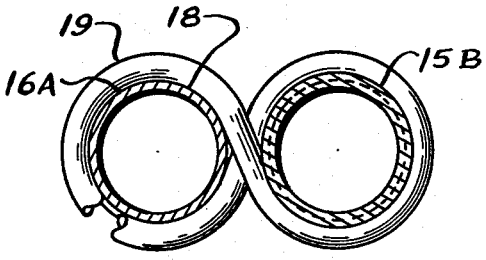
Fig. 3
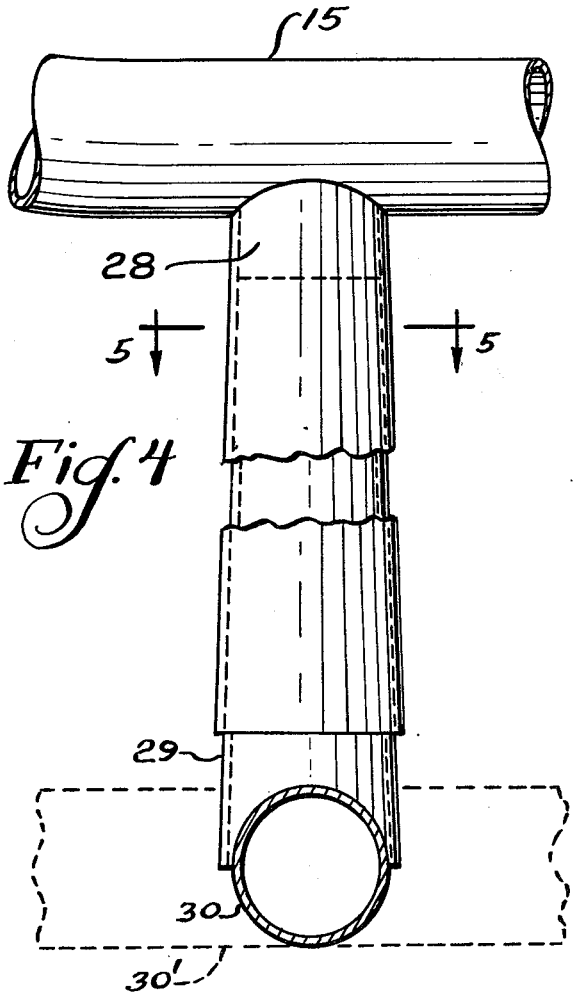
Fig. 4

PORTABLE INDUSTRIAL SCREEN

BACKGROUND AND SUMMARY OF THE INVENTION

The present invention is concerned with portable industrial screens of the type that are used, for example, at a location at which electric arc welding is being carried out. The radiation from such a welding operation can be very harmful to the eyes of a person who looks at it without the use of protective glasses or the like. Of course the welder who is actually performing the welding operation will wear such protective equipment, but in a shop it is likely that there will be other persons in the area who are not wearing such protective equipment. Even though they know better, such persons may thoughtlessly allow their eyes to be directed at the welding operation, the result being that their eyes can thereby become damaged. To prevent such thoughtless accidents from occurring, it is conventional to employ screens to obscure the welding arc from all but the welder himself. Since it is common in a large shop to have the welding operation performed in various locations as the need arises, these screens are of a type which are easily moved from place to place as the need arises. Also, at different locations where welding is being performed, it may be desirable to have screens of different shapes.

To meet the foregoing requirements, it is conventional for such a screen to be formed of a plurality of sections or panels with each adjacent pair of sections being connected by a suitable hinge structure. Each section consists of a rectangular frame, the sides of which are of relatively small cross-sectional dimensions, and a screen stretched between the sides of the frame. Each section may or may not be provided with feet. While the positioning of adjacent frames at an angle to each other generally will provide the requisite stability for the screen, additional stability is obtainable by the use of feet and this additional stability may be significant when the adjacent screens are substantially parallel to each other.

The manufacture of such screens is a comparatively simple operation not requiring particularly sophisticated or expensive equipment. Consequently, almost anyone who desires to do so can go into the business of manufacturing and marketing the screens. The result is that that business is highly competitive and price is an important factor in determining the buyer's choice between screens. While the buyer is, of course, desirous of obtaining a product that will have a good service life, he will not pay a significant premium in selecting one screen over another. Thus, an important aspect of the present invention is to provide a screen which will have a comparatively good service life yet at the same time will be highly cost competitive.

Not all purchasers of such screens prefer a screen with a particular number of sections or panels. One buyer may want a screen consisting of four sections while the next buyer may want only three. Another buyer may ask for a screen of two panels and some may even want but a single section. This causes a stocking problem for the retailer, typically a welding supply house. The retailer has the choice of stocking screens of various numbers of panels or only stocking one or two sizes (numbers of sections). In the latter event a sale may be lost when a purchaser asks for an unstocked size; even though the purchaser is advised that the requested size can be obtained upon order, since the purchaser may not want to wait for the time required for the retailer to obtain the desired screen. The present invention greatly ameliorates this problem for the retailer since the retailer need only stock screens with a substantial number of panels and if a request for a screen of a fewer number of panels is received, the retailer merely destroys the hinges connecting adjacent sections to produce the requested screen having a fewer number of sections. Since the hinges employed in the present invention are rubber bands, these are easily severed to divide a screen into two screens, each having a fewer number of sections. There is substantially no economic waste to the retailer since the value of the destroyed rubber bands is minimal and the section(s), removed from the original screen that the retailer had in stock to produce one of the requested number of sections, is saleable by itself.

Another advantage of the present invention is that the form of the section frames is such that they may be packaged disassembled in a relatively small container, yet the required assembly operations at the time a screen is sold are simple and uncomplicated. The size of the container is important to the retailer because of his necessity of having the best stock available within the space limitations of his building. Yet, he cannot afford to stock items that would require extensive assembly time on his part or the part of his customers.

Further objects and advantages will become apparent from the following description and drawings.

DESCRIPTION OF THE DRAWINGS

FIG. 1 is an elevational view of a screen consisting of three frames or panels and embodying the present invention;

FIG. 2 is an enlarged fragmentary view illustrating the rubber band hinge employed in the screen of FIG. 1;

FIG. 3 is a section taken at line 3—3 of FIG. 2;

FIG. 4 is an enlarged elevational view of the foot employed on the screen of FIG. 1;

DESCRIPTION OF SPECIFIC EMBODIMENTS

Figure 5:
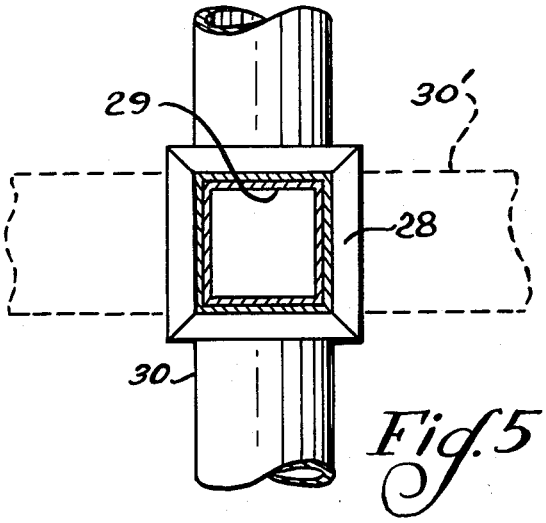
FIG. 5 is a section taken at line 5—5 of FIG. 4.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The screen depicted in FIG. 1 consists of three sections or panels, generally A, B and C. Each of these is identical with the other. Each comprises a frame 10A, 10B and 10C respectively on which is secured a curtain 11A, 11B and 11C respectively with a plurality of S hooks 12. The portion of the frame holding the curtain is formed by upper tubes 13A, 13B and 13C and lower tubes 14A, 14B and 14C telescoped into left side tubes 15A, 15B and 15C and right side tubes 16A, 16B, and 16C. The top and bottom tubes are identical as are the left and right tubes. The side tubes form not only the sides but also the corners and part of the top and bottom of the frame.

Each of the side tubes has a groove 18 spun therein adjacent the top and bottom thereof. These grooves form seats for rubber bands 19 which serve as hinges to hold the adjacent sides of adjacent panels together and to permit them to be pivoted with respect to each other in the manner of a hinge. As seen in FIGS. 2 and 3, the rubber bands are looped about the adjacent sides in figure eight fashion. While these are referred to herein as rubber bands, their appearance is actually more like O-rings than rubber bands since they are circular in cross-section and have a relatively large diameter as compared to the cross-sectional size of the usual rubber band. The rubber from which they are made also should be significantly different from that of the normal rubber band which is made of a relatively soft rubber, e.g., thirty Durometer. For use in connection with the present invention, the rubber bands should have a Durometer of between about fifty and about ninety. If the Durometer is below about fifty too much stretching of the rubber band is required. It also may be necessary to use too large a cross section. Also, with the soft rubbers one turn (or a portion thereof) frictionally engages an adjacent turn and the band will climb out of the grooves. If the Durometer is above about ninety the rubber bands are too difficult to put into place.

The rubber bands should have a substantial cross-sectional area in order that they have the required strength. Thus the minimum area should not be less than about that of one-eight inch (3.175 m.m.) diameter, i.e., an area of 0.05 square inches (7.92 m.m. sq.). If they are too large they become too difficult to put into place and the maximum should not be over that of a one-quarter inch (6.35 m.m.) diameter, i.e., 0.12 square inches (31.67 m.m. sq.).The rubber band should be stretched in excess of about twenty-five percent of its normal relaxed length when it is in place and acting as a hinge, i.e., as depicted in the drawing. In actual practice I have had them stretched about forty-five percent of their normal relaxed length. For example, a belt installed over two one inch (2.54 c.m.) diameter tubes having thirteen-sixteenths (2.064 c.m.) diameter grooves would have a relaxed circumference of 4.3125 inches (10.954 c.m.) and a circumference when in place of 6.25 inches (15.875 c.m.). for the purpose of enabling the rubber band to be put in place, it should be capable of being stretched to twice its normal relaxed length without suffering any damage.

The rubber bands are, of course, put in place before the top and bottom portions 13A and 14B are assembled thereto. Two of the side members, for example, 15B and 16A are placed into complete juxtaposition, that is, with the top and bottom portions thereof juxtaposed, rather than being spread apart as depicted in FIG. 1. The rubber band is then formed into figure eight fashion and slipped over the upper ends of the members 16A and 15B, gradually worked about the top corner and down the vertical portion thereof until reaching the respective seat defined by the grooves 18. When the adjacent sides are connected by the two rubber bands, they can be rotated to adjust the angular position of the frames with respect to each other. As this is done the rubber band is a moving constraint and there is no significant slipping within the band. The adjacent sides of the frames are held parallel by the bands during this movement.

Figure 6:
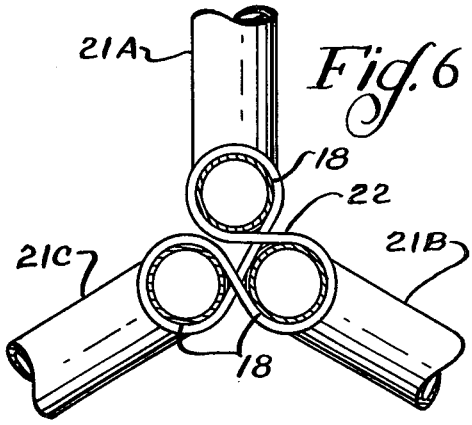
FIG. 6 is a view similar to FIG. 3, but showing a screen in which there are three sections or panels adjacent to each other and hinged together with a single rubber hand at each "hinge" location.
Figure 7:
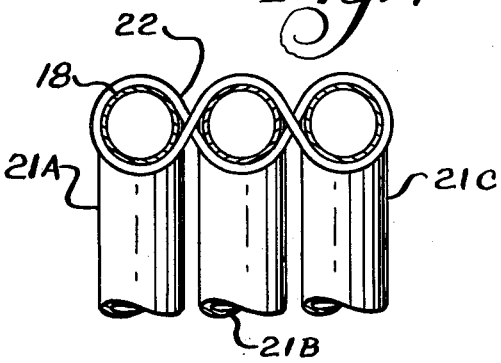
FIG. 7 illustrates the embodiment of FIG. 6 with the three sections turned to be parallel to each other for transport.

FIGS. 6 and 7 illustrate how a screen may be formed using three side members 21A, 21B and 21C (each corresponding to 15A or 16A, etc.) Both FIGS. 6 and 7 illustrate the identical manner of looping a rubber band 22 about these three side members. When the three panels, of which the side members 21A, 21B and 21C are portions, are fanned out the rubber band would have the appearance illustrated in FIG. 6. However, when these side members are in juxtaposition the appearance would correspond to that of FIG. 7.

Figure 8:
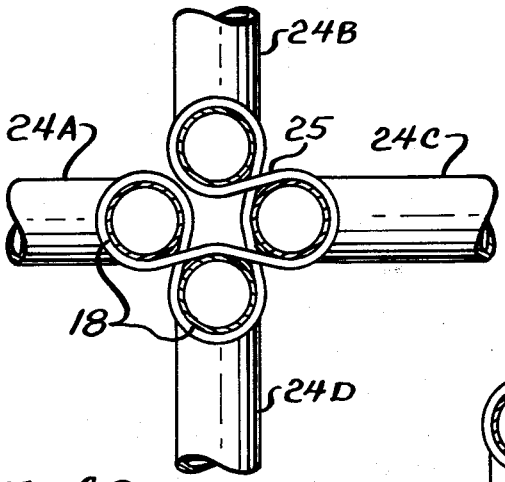
FIG. 8 is a view similar to FIG. 3, but showing a screen in which there are four sections adjacent to each other and hinged together with a single rubber band at each "hinge" location.
Figure 9:
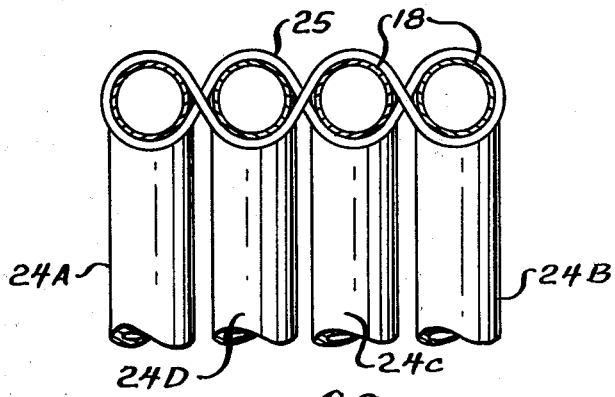
FIG. 9 illustrates the embodiment of FIG. 8 with the sections turned so as to be parallel to each other.

Similarly, FIGS. 8 and 9 illustrate the manner in which four panels may be connected so as to have their side members 24A, 24B, 24C and 24D in juxtaposition and the arrangement of the rubber band 25 therewith.

Each of the panels A, B and C has a pair of feet, generally 27. The form thereof is best seen by reference to FIGS. 4 and 5. Each foot includes a socket member 28 welded to and extending down from the bottom portion of a side member 15 or 16. The socket defines an internal opening which is square in cross-section and tapers from top to bottom in a manner such that the bottom is larger than the top. An inverted tee-shaped foot member consists of an upright part 29 and a lower bar part 30. These are suitably secured together as by means of welding. The upright part 29 has the exterior thereof square in transverse cross-section and tapered corresponding to the taper of the internal opening of the socket member 28.

When the screen normally is in use, the upright part 29 normally is inserted into the socket member in a manner such that the lower bar part 30 is transverse to the panel, which is the position illustrated in full line in the drawing. However, for packing and shipping or for storage, the lower bar part would be positioned parallel to the panel, as illustrated by dotted line 30'. With the complementary tapers of the socket and the upright part the latter may be wedged into the socket and held therein by friction. This permits a person to lift and move the screen without the feet falling off. To change position, the upright part is withdrawn from the socket (perhaps by tapping downwardly on the bar part with a suitable tool), rotated ninety degrees and reinserted into the socket member.

Normally for packing and shipping the panels would be in disassembled form, except that the rubber bands 19 connecting adjacent panels would be in place and each foot member 29, 30 would be in its respective socket member in the manner illustrated by dotted lines 30'. As thus disassembled, the screen would be packed into a suitable container. The container might hold a screen of one, two, three, etc., number of panels. After removal from the shipping container the top and bottom members 13 and 14 would be telescoped into the side members 15 and 16. Suitable abutments may be used on the outside of members 13A and 14A or on the inside of members 15 and 16 to prevent the former from slipping too far into the latter. After each frame was in rectangular form the curtain 11 would be placed therein by means of hooks 12. With the curtain in place the frame parts cannot slip apart.

The dealer will be supplied with a stock which comprises a plurality of boxes each holding but a single panel for a screen. In each box will be all the components for the panel, but the two side members (e.g., 16A and 15B) will be connected by the rubber bands. If the purchaser would want but a single panel, he would buy but one box and sever the rubber bands so that the two side members can be used on opposite sides of the panel. If the purchaser desires a screen of a plurality of panels, he would purchase the appropriate number of boxes and sever the rubber bands in one, only, of the boxes. The two side members that were thus separated would become the distal sides of the distal screens (e.g., 15A and 16C) while the side members of the other boxes would become the intermediate side members (e.g., 16A, 15B and 16B, 15C). Thus the dealer's stocking problem is greatly simplified without impairing his ability to supply the needs of his customers.

I claim:

1. A folding portable screen for use about an area in a shop or the like in which welding is taking place in order to confine the optically harmful radiation, said screen comprising a plurality of generally rectangular, tubular metal frames each including a pair of vertical portions and a pair of horizontal portions with corners between the horizontal and vertical portions, fabric screens mounted in each of said frames respectively and connected to each of said portions, hinge means connecting the adjacent vertical portions of each adjacent pair of frames, and two support devices attached to each lower horizontal portions for supporting the screen on a floor or the like, characterized by:

each frame consisting of four elements, a first two of the elements forming one of said pair of portions, the corners and parts of the second pair of portions, the remaining two of the elements forming the remainder of the second pair of portions, the elements of said first two elements being telescopically fitted to said remaining two elements and being held against telescopic separation by said fabric being connected to each of said portions, each said adjacent vertical portion having two spaced, circumferential grooves therein in juxtaposition to corresponding grooves in the adjacent vertical portion of the adjacent frame;

said hinge means consisting of a rubber band seated in the grooves of said adjacent vertical portions, and encircling and interconnecting said adjacent vertical portions of said adjacent screens, each rubber band when in place interconnecting said vertical portions having a length somewhat greater than its relaxed length prior to being so positioned so that it is in tension, whereby the frames are normally held securely together but can be pivoted with respect to each other, and the number of frames constituting a screen may be diminished by severing the rubber bands connecting an adjacent pair of frames; and each device comprising:

a tubular socket attached to and extending vertically downward from said lower portion and defining an internal socket opening, open at the bottom, square in cross-section, and tapered with the smaller part thereof at the top and the larger part thereof at the bottom; and an inverted tee-shaped foot member consisting of an upright part and a lower bar part normal to the upright part, said upright part having the exterior thereof square and tapered complementary to and seated in said socket opening;

whereby said taper permits said upright part to be wedged into said socket to normally hold it in place without the necessity for other fasteners and yet the upright part may be removed from the socket to permit the foot to be rotated ninety degrees and the upright part reinserted into the socket in that rotated position.

2. A folding screen as set forth in claim 1, wherein each rubber band has a cross-sectional area between about 0.12 square inches and about 0.05 square inches and has a hardness of between about fifty and about ninety Durometer.

3. A folding screen as set forth in claim 2, wherein each rubber band will stretch twice its normal relaxed length and when in place as a hinge means being stretched in excess of about twenty-five percent of said normal relaxed length.

* * * * *